US009617050B2

(12) United States Patent
Dreyer et al.

(10) Patent No.: US 9,617,050 B2
(45) Date of Patent: Apr. 11, 2017

(54) CONTAINER CLOSURE ASSEMBLY

(75) Inventors: Lino Dreyer, Rixheim (FR); Klaus Thanisch, Bullay (DE); Klaus Natersky, Grenderich (DE)

(73) Assignee: OBRIST CLOSURES SWITZERLAND GMBH, Reinach (CH)

( * ) Notice: Subject to any disclaimer, the term of this patent is extended or adjusted under 35 U.S.C. 154(b) by 0 days.

(21) Appl. No.: 13/393,635

(22) PCT Filed: Sep. 1, 2010

(86) PCT No.: PCT/EP2010/062801

§ 371 (c)(1),
(2), (4) Date: Mar. 6, 2012

(87) PCT Pub. No.: WO2011/026861

PCT Pub. Date: Mar. 10, 2011

(65) Prior Publication Data

US 2012/0152770 A1 Jun. 21, 2012

(30) Foreign Application Priority Data

Sep. 4, 2009 (EP) ..... 09169490

(51) Int. Cl.
*B65D 51/28* (2006.01)

(52) U.S. Cl.
CPC ..... *B65D 51/2807* (2013.01); *B65D 51/2892* (2013.01)

(58) Field of Classification Search
CPC ..... B65D 51/2864; B65D 51/2892; B65D 51/2807; B65D 51/28; B65D 25/00
(Continued)

(56) References Cited

U.S. PATENT DOCUMENTS 3,924,741 A * 12/1975 Kachur et al. ..... 206/221
4,947,986 A * 8/1990 Ballu ..... 206/221
(Continued)

FOREIGN PATENT DOCUMENTS

DE 29820062 2/1999
EP 1477421 11/2004
(Continued)

*Primary Examiner* — King M Chu
(74) *Attorney, Agent, or Firm* — Davis & Bujold PLLC; Michael J. Bujold

(57) ABSTRACT

A closure assembly has a closure cap (2) adapted to be fitted to the neck of container to close the container. The cap (2) has an upper wall (4) and a cylindrical skirt (5) depending therefrom. A reservoir (7) is formed on the underside of the upper wall (4) radially within the skirt (5) and has a dispensing opening (9). A closing member (3) is fitted into the closure cap (2) to close the dispensing opening in the reservoir. When the closure cap (2) is removed from the container, the closing member (3) remains held within the neck of the container and is separated from the closure cap so that the dispensing opening is opened and material contained therein is dispensed into the container. The closure cap is provided with sealing means for directly sealing against the neck of a container such as an annular wall (12) extendin downwardly from the underside of the upper wall of the closure cap (2) to fit sealingly into the neck of the container.

9 Claims, 5 Drawing Sheets

(58) Field of Classification Search
USPC .... 206/568, 219, 221; 215/227, 344, DIG. 8
See application file for complete search history.

(56) References Cited

U.S. PATENT DOCUMENTS

| | | | | |
|---|---|---|---|---|
| 5,967,309 | A * | 10/1999 | Robles-Gonzalez et al. | 206/221 |
| 6,003,728 | A * | 12/1999 | Elliott | 222/81 |
| 6,149,866 | A * | 11/2000 | Luotola et al. | 422/401 |
| 7,178,683 | B2 * | 2/2007 | Birkmayer et al. | 215/257 |
| 7,588,142 | B1 * | 9/2009 | Bush | 206/221 |
| 2004/0200741 | A1 | 10/2004 | Cho | |
| 2004/0200856 | A1 | 10/2004 | Cho | |
| 2006/0118435 | A1 * | 6/2006 | Cronin et al. | 206/219 |
| 2006/0255003 | A1 * | 11/2006 | Fuchs | 215/252 |
| 2007/0193893 | A1 * | 8/2007 | Lee et al. | 206/219 |
| 2008/0035497 | A1 * | 2/2008 | Im | 206/219 |
| 2008/0135514 | A1 * | 6/2008 | Brosius | 215/344 |

FOREIGN PATENT DOCUMENTS

| | | |
|---|---|---|
| EP | 1919791 | 5/2008 |
| WO | 2005/097615 | 10/2005 |
| WO | 2007/020169 | 2/2007 |

* cited by examiner

CONTAINER CLOSURE ASSEMBLY

The invention relates to container closure assemblies incorporating a reservoir for material (typically a liquid, a powder or a granulate material) which is kept separate from the material (typically liquid) in the container until mixing of the materials is required.

Such arrangements are known, for example, in relation to certain drinks where the drink is best consumed only shortly after the mixing has taken place.

In one known arrangement a generally cylindrical reservoir for liquid is screw threaded into an annular end piece fitted irremovably to the neck of a container. When the reservoir is removed from the end piece, a closure member is dislodged from the reservoir and drops into the container allowing liquid in the reservoir to be dispensed through the end piece into the container. When the reservoir has been completely removed from the end piece the mixed liquids can be poured through the end piece.

US 2004/0200741 discloses a cap device for bottles, in which a valve means is stably placed at a desired position in a neck of a bottle, which allows an additive to be stored completely separated in the cap device. The cap device has a funnel part integrally formed in the cap body to discharge the additive from the cap body into the bottle through a lower end thereof.

DE 29820062 concerns a closure cap with an additional container, the container having a bottom wall which is connected to the sidewall by a predetermined breaking line. The closure cap further comprises a cylindrically formed pusher, such that the container is opened when the pusher moves axially towards the container bottom.

The arrangements described above are not suitable for use with standard container filling apparatus using, for example, standard (PCO neck finish) PET bottles and standard profile closure caps which are screwed onto the bottles and removed therefrom by unscrewing and breaking a tamper evident ring. In the prior arrangement the bottle form must be different since the end piece must not be removable and the profile of the end piece with reservoir fitted is entirely different from that of a standard closure cap.

EP 1 477 421 concerns a closure cap comprising a cylindrical wall projecting axially from the top wall and forming a receiving chamber. The receiving chamber has an opening at its lower end. A seal plug is removably attachable to the cylindrical wall to close the chamber. A sleeve with a protruding portion is arranged to be fixed to the opening portion of the vessel. The seal plug is only allowed to pass the protruding portion in direction of insertion but not in direction of removal. Thus the plug remains underneath the protruding portion when the closures cap is removed from the vessel and the receiving chamber is opened. The plug is not fixed with respect to the container after opening and hence is free to move. The plug may thus block the opening when the content shall be removed from the container.

EP 1 919 791 shows a closure cap adapted to be fitted to the neck of a container to close the container comprising an upper wall and a cylindrical skirt depending therefrom and having a reservoir formed on the underside of the upper wall within the skirt. The reservoir is provided with a dispensing opening. A sealing member is adapted to be fitted into the closure cap to close the dispensing opening in the reservoir. The sealing member is also adapted to fit into the neck of the container, when the assembly is fitted thereto, with an interference fit such that when the closure cap is removed from the container, the sealing member remains held within the neck of the container and is separated from the closure cap so that the dispensing opening is opened and material contained therein is dispensed into the container. The sealing member extends to the upper edge of the container neck. A second cylindrical wall extends downwardly from the underside of the closure cap radially outwardly of the reservoir and fits sealingly into the upper end of the sealing member.

When the closure is opened there is a friction force between the second cylindrical wall and the sealing member. Due to this friction force the closure may be difficult to open. Further more the sealing member may be loosened by being turned together with the closure. Also, since the sealing member extends to the upper edge, a consumer might remove the sealing member after having detached the closure cap making it impossible to sealingly reclose the container after first opening.

It is the aim of the present invention to provide a solution which avoids the disadvantages of the prior art, in which no modification to the industry standard bottle is required and in which the profile of the closure is such that it can be handled on unmodified filling lines, which closure can be easily removed by the consumer and which allows reliable resealing after first opening.

Accordingly, the invention provides a closure assembly with closure cap adapted to be fitted to the neck of a container to close the container and comprising an upper wall and a cylindrical skirt depending therefrom. A reservoir is formed on the underside of the upper wall within the skirt and is provided with a dispensing opening and a closing member to close the dispensing opening of the reservoir. The closing member comprises a fixing member, a plug member and a passage element. The fixing member is adapted to fit into the neck of the container, when the assembly is fitted thereto, with an interference fit such that when the closure cap is removed from the container, the closing member remains held within the neck of the container. The plug member is adapted to sealingly fit into an open end of the reservoir to close the reservoir when the closure cap and the closing member are fitted together. The passage element allows material to be dispensed from the reservoir into the container when the closure cap is removed from the container neck and the closing member is separated from the closure cap. The closing member remains in the container neck as a whole. The seal between plug member and reservoir is broken and material is dispensed from the reservoir into the container through the passage element.

The closure cap is provided with separate sealing means such as sealing lips or a sealing liner for directly sealing against the container neck. Preferably, an annular wall extends downwardly from the underside of the upper wall of the closure cap to fit sealingly into the neck of the container.

The arrangement allows for the reservoir to be filled and the sealing member to be fitted to the closure cap to form an assembly which can be freely transported and handled by standard machinery set up to handle a plain container closure consisting simply of an end wall and a depending skirt. The annular wall can directly seal against the inner surface of a container neck. Thus, an approved standard sealing lip can be used.

When the closure cap is separated from the container neck the closing member remains within the container neck. Thus there are two seals to be released: A first sealing between the reservoir and the closing member is formed by the plug element of the closing member which seals the reservoir. A second sealing between the closure cap and the container neck is formed by a standard sealing means forming a seal between the closure cap and the container neck, such as an annular wall.

These two sealing effects are completely independent.

The fixation of the closing member in the container will stay intact when the closure cap is removed from the bottle and the content of the reservoir will be dispensed into the container.

Preferably the fixing member is arranged axially below the annular wall, when the assembly is fitted to the container.

Hence, once the connection between plug element and reservoir is removed, there is no more friction between the closing member and the closure cap. Thus there is no risk of turning or rotating the closing member together with the closure cap and there is no friction force between the closure cap and the closing element impeding the opening of the container or loosening the closing member.

The fixing member and the annular wall are both adapted to fit into the neck of the container, thus the upper section of the container neck is occupied by the annular wall, whereas the sealing member is arranged in the lower section and has an axial distance from the upper end of the container neck.

When the closure cap has been removed and the mixed content of the container may be poured out, the user will be unable to remove the closing member being arranged inside of the container.

Beneficially the annular wall comprises a closure sealing zone, in which the outer diameter of the annular wall is greater than the inner diameter of the container neck. This region provides a reliable sealing between closure cap and container as long as the closure cap is fitted to the container. Such seals typically are known as olive seals.

In a preferred embodiment the fixing member comprises at least one fixation zone, in which the outer diameter of the sealing member is greater than the inner diameter of the container neck, more preferably there are two or three fixation zones in an axial distance form another. The fixation zones support a reliable contact between the fixing member and the container neck and support for the closing member remaining in the container neck when the closure cap is removed.

Preferably the reservoir is formed by an annular reservoir wall, more preferably a cylindrical wall, extending downwardly from the underside of the upper wall of the closure cap.

With a reservoir being formed cylindrically the closure cap may be easily completely deformed from a mould while at the same time offering enough volume inside the reservoir.

The reservoir may also be formed by a downwardly extending wall which is slightly conical.

The reservoir wall provides at his end an undercut which snaps with the closing member, preventing therefore that said closing member falls out accidentally during handling or transportation.

The passage element may be furnished with windows. As long as the closure cap is applied to the container neck and as long as it is in the closing position the reservoir is closed by the plug member and the content of the reservoir may not pour through the windows.

Preferably the passage element comprises a plurality of radial bridges and passages are formed between the radial bridges such that when the closure cap is separated from the container neck and the closing member, material can be dispensed from the reservoir through the passages and into the container.

The bridges form a connection between the plug element and the fixing element.

Advantageously the axial length of the reservoir corresponds approximately to the sum of the axial length of the fixing member and the axial length of the annular wall. The axial length of the fixing member is longer than the axial length of the annular wall, since the closure cap has to be removed from the container neck for opening and the closing member is meant to remain inside the container neck and thus needs a sufficient contact area.

Additionally the closure cap may comprise at least one centring member extending downwardly from the underside of the upper wall radially outwardly of the reservoir and radially inwardly of the annular wall, preferably arranged on the outer surface of the wall defining the reservoir.

The centring members help to adjust the fixing members with respect to the container neck when the closure cap is applied to the container.

The problem being object of the invention is also solved by an assembly as described above in combination with a container having a neck with an external screw thread; the closure cap being formed with a corresponding screw thread on the inside of the depending skirt for fitting the assembly to the container.

Embodiments of the invention are described below with reference to the accompanying drawings in which.

Figure 2:
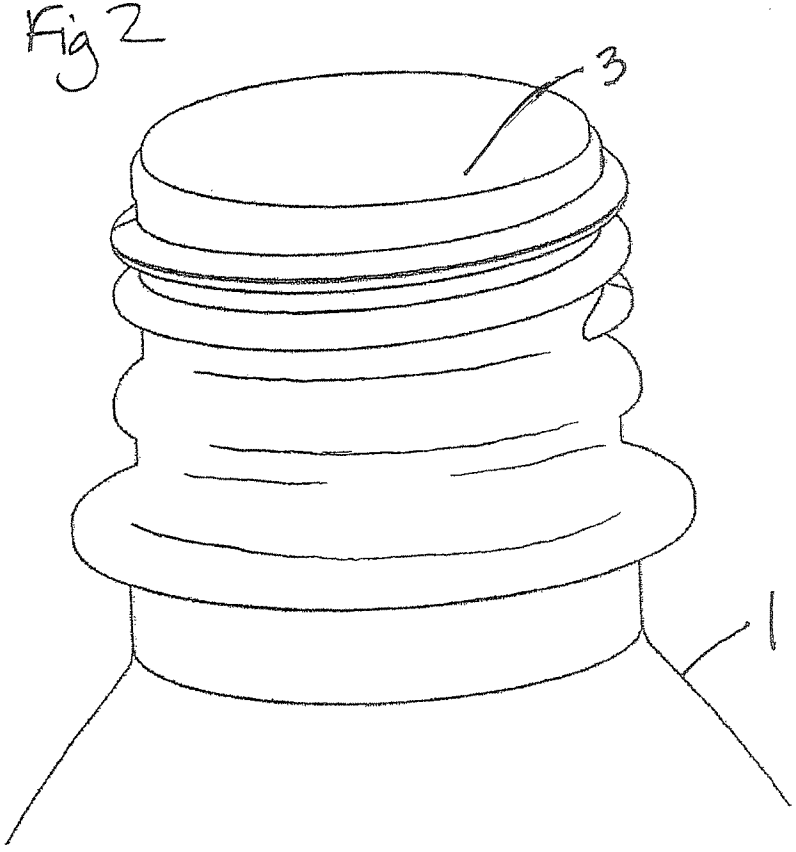
FIG. 2 is a perspective view of the top of the container with the closure cap removed.
Figure 1:
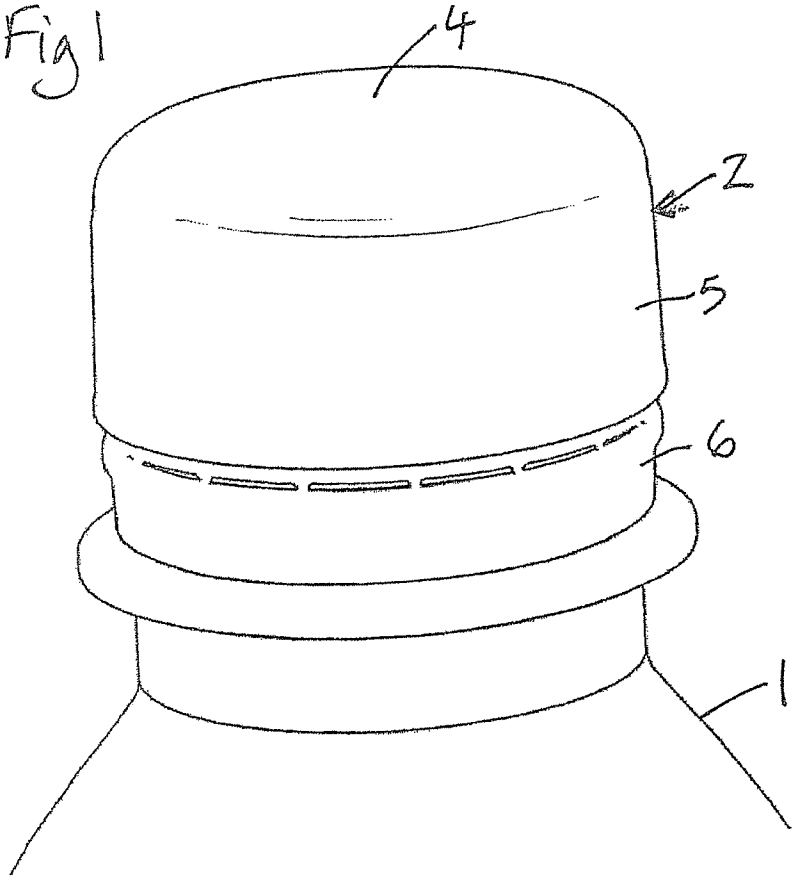
FIG. 1 is a perspective view of the top of a container fitted with a closure assembly according to the invention.
Figure 3:
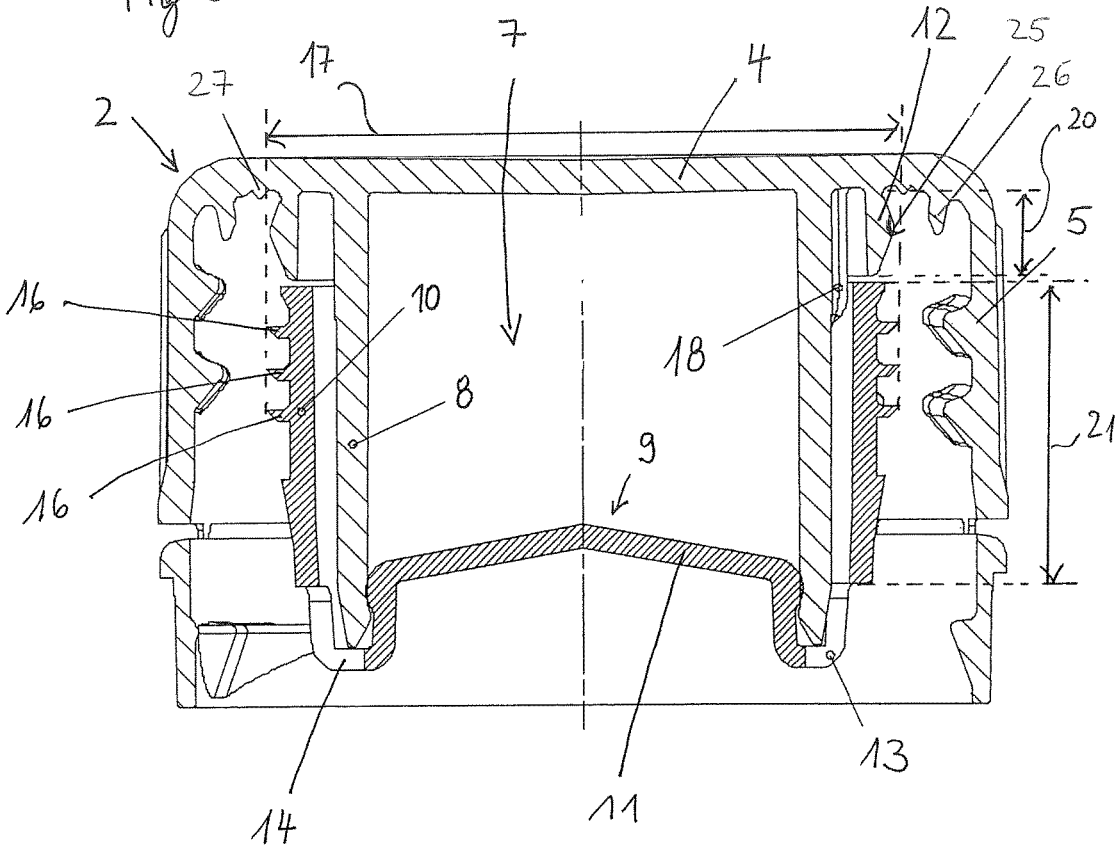
FIG. 3 is a vertical section through the closure cap assembly.

The closure assembly shown in the drawings is for use with a container 1 having an external screw thread on its neck. The container is a bottle and typically will be made of a plastic material, for example PET, metal or glass. The closure assembly comprises a cap 2 and a closing member 3, as can be seen in FIGS. 2 and 3. The cap 2 has an upper wall 4 with a cylindrical skirt 5 depending therefrom. The skirt has an internal screw thread on the inside of the skirt for fitting to the container. As shown in FIG. 1, the cap is formed with a tamper indicating ring 6 which is broken away from the skirt when the closure is first opened. As also seen from FIG. 1, the outer shape of the cap is entirely conventional.

As can be seen in FIG. 3 a reservoir 7 is formed within the skirt 5 on the underside of the upper wall 4 of the cap. The reservoir is formed by a mainly cylindrical reservoir wall 8 extending downwardly from the underside of the upper wall 4. A dispensing opening 9 is defined by the free end of the wall 8.

The closing member 3 is sized to be fitted into the closure to close the dispensing opening 9. The closing member 3 comprises a fixing member 10, a plug member 11 is supported coaxially within the fixing member 10 at its lower end by a passage member 13, preferably comprising a plurality of bridges 14, preferably four or six. The greater the diameters of the reservoir 7, the plug member 11 and the fixing member 10 are, the more bridges 14 may be arranged around the plug member 11.

The plug member 11 fits into the open end of the reservoir wall 8 to form a bore seal therewith to close the reservoir 7. The plug 11 may be a snap fit in the wall 8 to help retain the assembly of cap 2 and sealing member 3 in fitted relationship during transport, storage and handling of the assembly.

An annular wall 12 extends downwardly from the underside of the closure cap radially outwardly of the reservoir and fits sealingly into the upper end of the container neck. The annular wall has a convex shape (seen in the axial direction) on its outer surface forming a sealing area 25 having a diameter larger than the inner diameter of the container neck. Such a seal is typically known as olive seal. Furthermore, the closure cap 2 may have further conventional sealing members such as an outer sealing lip 26 or a top sealing lip 27.

Additionally or alternatively the closure cap may comprise any conventional sealing member, such as a conically formed wall extending from inside of the closure cap.

When the assembly is fitted to the container 1 (not shown in FIG. 3), the fixing member 10 of the closing member fits into the neck of the container with an interference fit such that when the closure cap 2 is unscrewed from the container 1, the fixing member 10 remains held within the neck of the container 1 and the closing member 3 is separated from the closure cap 2. As the cap 2 and closing member 3 are separated, the plug member 11 comes out of the wall 8 of the reservoir so that the dispensing opening 9 is opened. A liquid, powder or granulate material held in the reservoir can then pass out of the reservoir to be dispensed into the container through passages 15 in the closing member formed between the bridges 14. The mixed contents of the container can then be poured out through the passages 15.

The axial length of the reservoir 7 mainly corresponds to the sum of the axial length 21 of the fixing member 10 and the axial length 20 of the annular wall 12. Thus the axial length 21 of the fixing member 10 may be chosen to be sufficient for providing a well adjusted position and for avoiding a tilting of the closing member 3.

Further more the length for the fixating member 10 can be chosen independently from the length 20 of the annular wall 12.

As best shown in FIG. 3, the fixing member 10 is provided with three contact zones or fixation zones 16 having an outer diameter 17 being greater than the inner diameter of the container neck and forming a friction fit between the container neck and closing member 3.

The cap 2 further comprises centring elements 18 arranged on the outer surface of the wall 8.

Figure 4:
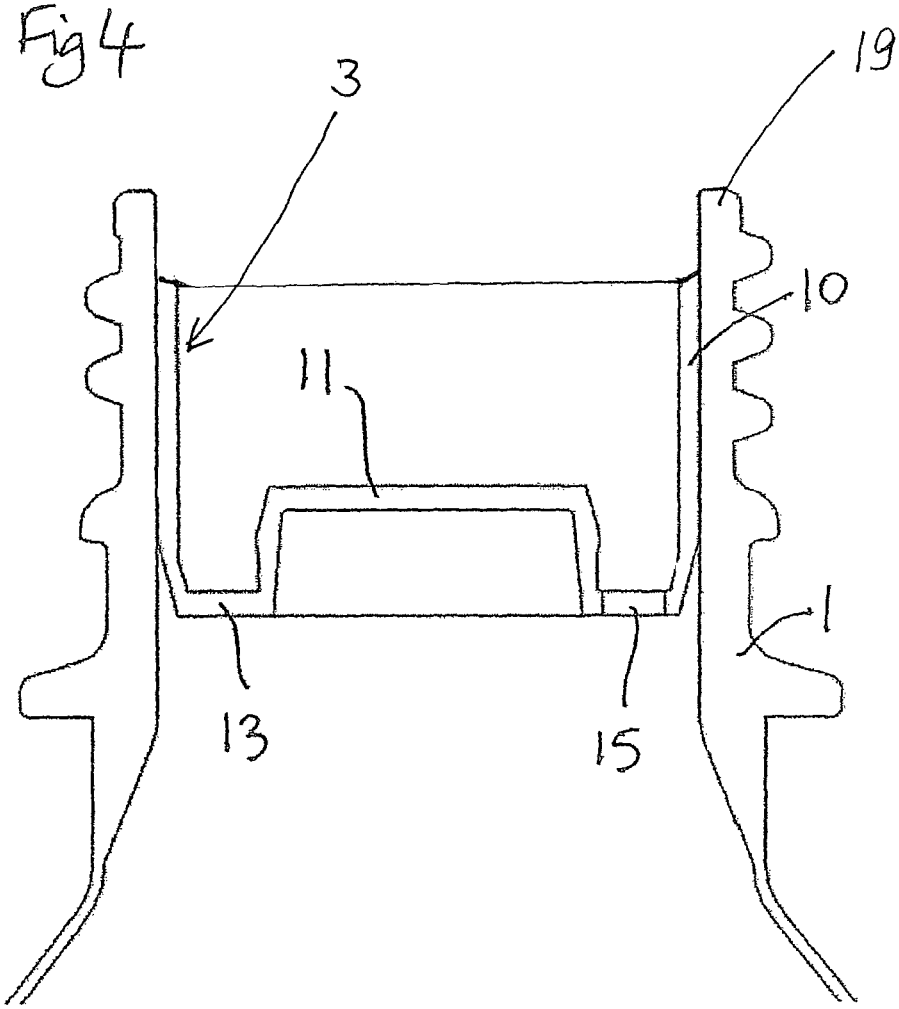
FIG. 4 is a vertical section through the top of a container with the closure cap removed but with the fixing member located in the neck of the container.

As can be see in FIG. 4 the upper end of the fixing member 10 rests below the upper rim 19 of the container neck 1. Thus a person drinking directly form the container would not necessarily come into contact with the closing member 3 and cannot easily remove the closing member.

In an assembly for use on a standard 28 mm diameter bottle neck, the reservoir may have a diameter of about 12 mm and will be filled to a depth of about 9 mm giving a liquid volume of about 1 ml. In an assembly for use on a 38 mm diameter bottle neck, the reservoir may have a diameter of about 22 mm and be filled to a depth of about 13 mm giving a liquid volume of about 5 ml. Such reservoirs will not extend below the skirt 5 or may extend only very slightly. If required, the reservoir could be made much deeper for certain applications but this will hinder high speed handling.

Figure 5:
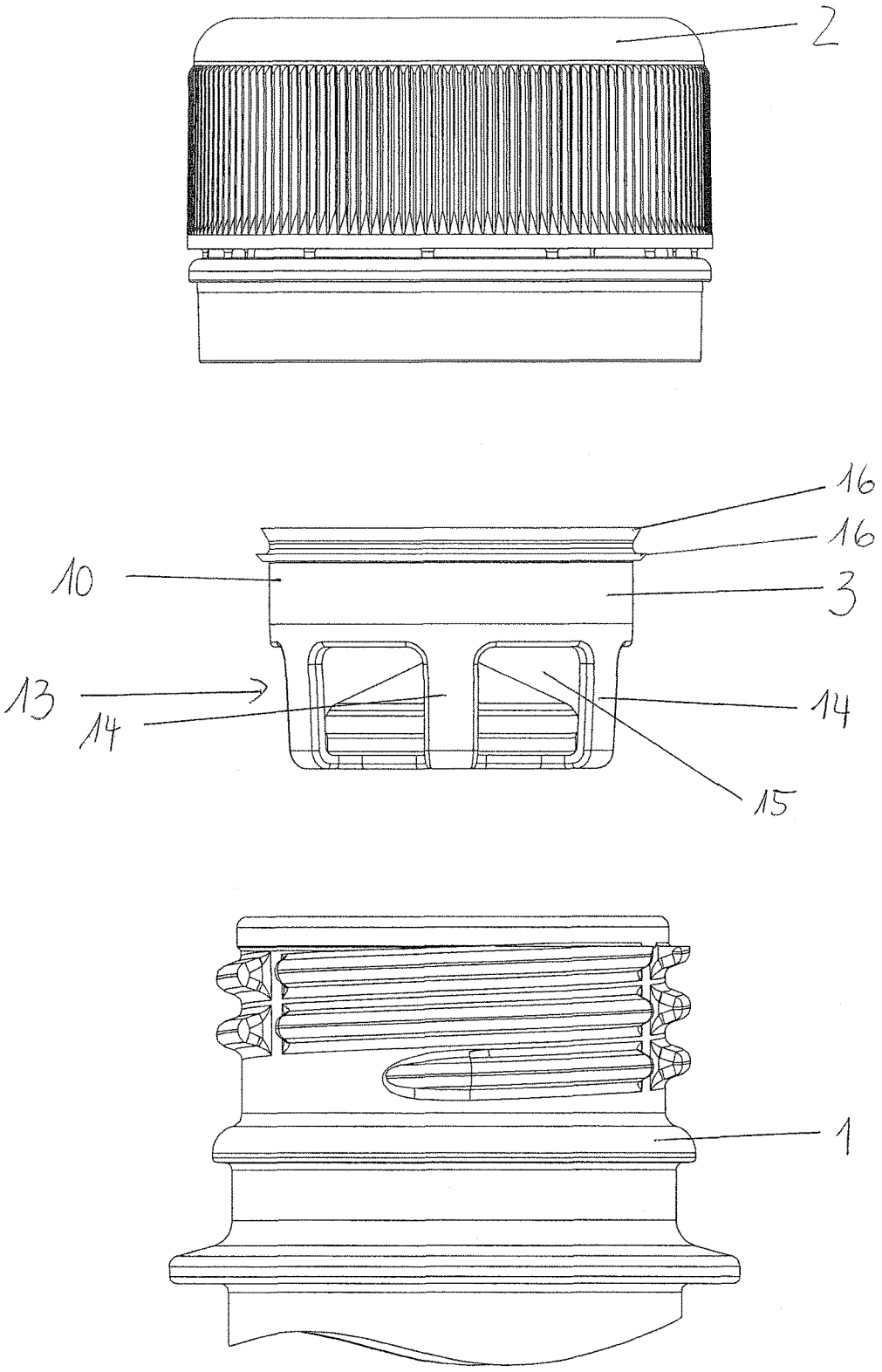
FIG. 5 is a perspective view of a further example of a container, a closing member and a closure cap.

FIG. 5 is a perspective view of a further example of a container 1, a closing member 3 and a closure cap 2.

The closure cap 2 again has a conventional outer appearance.

The closing member 3 comprises a fixing member 10 with two fixation zones 16. The passage element 13 comprises six bridges 14 with passages 15 in between.

Figure 6:
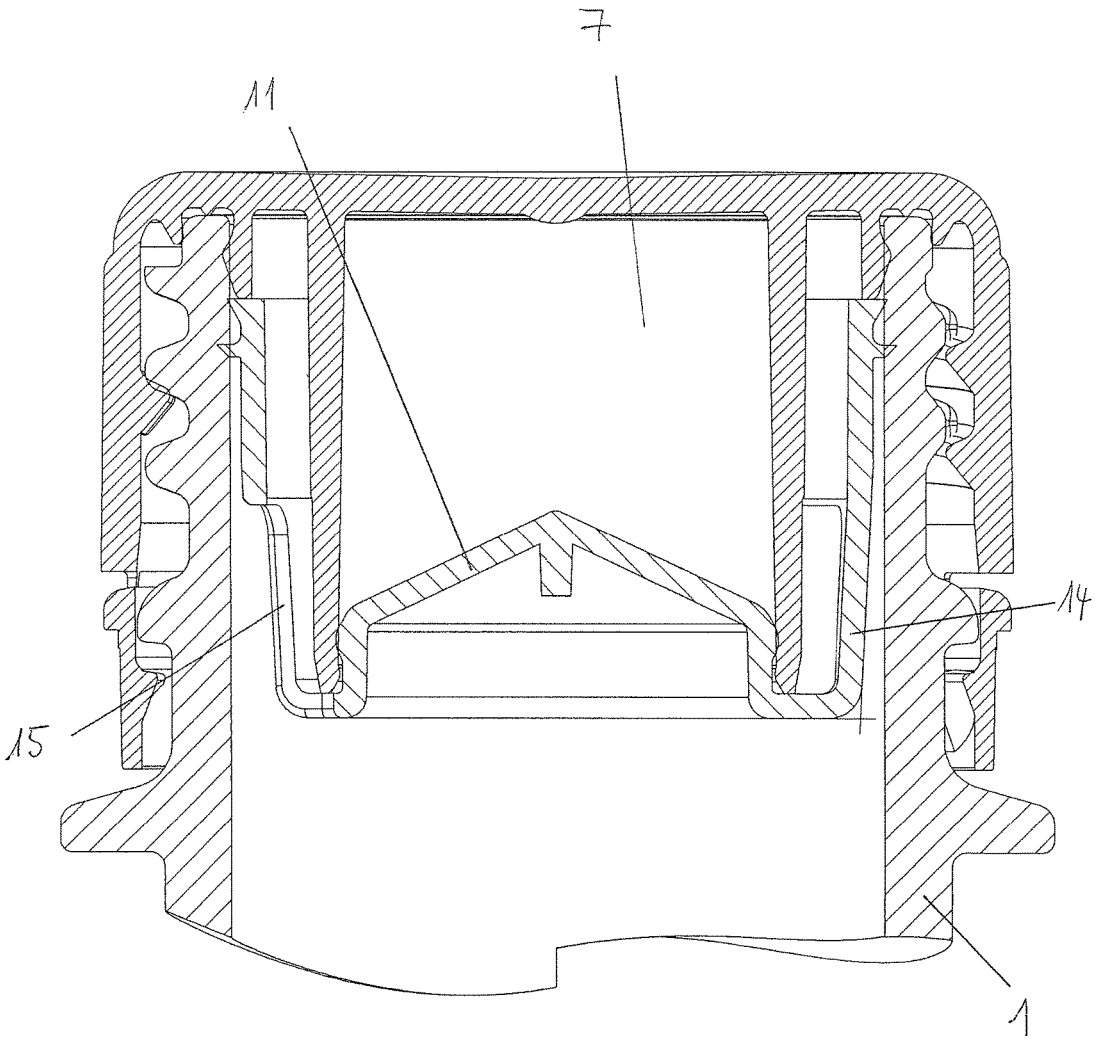
FIG. 6 is vertical section though the further example of the closure cap applied to the container.

FIG. 6 is a vertical section through the same closure assembly applied to the container 1. As can be seen in this figure the plug member 11 is formed conical to allow a material stored in the reservoir 7 to pour out easily through passages 15 between bridges 14.

The invention claimed is:

1. A closure assembly comprising:

a closure cap adapted to be fitted to the neck of a container to close the container, said cap comprising an upper wall and a cylindrical skirt depending there from, a reservoir being formed on an underside of the upper wall within the skirt for accommodating a material, and the reservoir being provided with a dispensing opening; and a closing member for closing the dispensing opening of the reservoir; and the closing member comprising:

a fixing member, the fixing member being adapted to fit into the neck of the container by an interference fit, when the closure assembly is fitted thereto, and the fixing member comprising at least one fixation zone having an outer diameter which is greater than an inner diameter of the container neck for forming the interference fit with the neck of the container;

a plug member, the plug member being adapted to fit into an open end of the reservoir for closing the reservoir when the closure cap and closing member are fitted together, and a passage element allowing material to be dispensed from the reservoir into the container, the interference fit being such that when the closure cap is removed from the container, the closing member remains held within the neck of the container and is separated from the closure cap so that the dispensing opening is opened and material contained therein is dispensed into the container, wherein the closure cap is provided with sealing means for directly sealing against the neck of such container, said sealing means is an annular wall extending downwardly from the underside of the upper wall of the closure cap to fit sealingly into the neck of the container.

2. The closure assembly according to claim 1, wherein the reservoir is formed by an annular reservoir wall extending downwardly from the underside of the upper wall of the closure cap.

3. The closure assembly according to claim 1, wherein the passage element comprises a plurality of radial bridges, passages being formed between the radial bridges such that when the closure cap is separated from the closing member, the material can be dispensed from the reservoir through the passages and into the container.

4. The closure assembly according to claim 2, wherein the passage element comprises a plurality of radial bridges, passages being formed between the radial bridges such that when the closure cap is separated from the closing member, the material can be dispensed from the reservoir through the passages and into the container.

5. The closure assembly according to claim 1, wherein the annular wall comprises a convex closure sealing zone, in which the outer diameter of the annular wall is greater than the inner diameter of the container neck.

6. The closure assembly according to claim 1, wherein the fixing member comprises at least the fixation zones.

7. The closure assembly according to claim 1, wherein the axial length of the reservoir mainly corresponds to a sum of the axial length of the fixing member and the axial length of the annular wall.

8. The closure assembly according to claim 1, wherein the closure cap comprises at least one centering member extending downwardly from the underside of the upper wall radially outwardly of the reservoir and radially inwardly of the annular wall.

9. The closure assembly according to claim 1 in combination with a container having a neck with an external screw thread; the closure cap being formed with a corresponding screw thread on the inside of the depending skirt for fitting the closure assembly to the container.

* * * * *